United States Patent [19]

Phillips

[11] Patent Number: 4,699,096

[45] Date of Patent: Oct. 13, 1987

[54] DETONATION PREVENTION MEANS FOR INTERNAL COMBUSTION ENGINE

[76] Inventor: Howard L. Phillips, P.O. Box 392, Safford, Ariz. 85546

[21] Appl. No.: 830,547

[22] Filed: Feb. 18, 1986

Related U.S. Application Data

[63] Continuation-in-part of Ser. No. 689,064, Jan. 7, 1985, abandoned.

[51] Int. Cl.[4] ..... F02N 17/08

[52] U.S. Cl. ..... 123/182; 123/164 V; 313/120

[58] Field of Search ..... 123/182, 169, 316, 425, 123/435; 313/120

[56] References Cited

U.S. PATENT DOCUMENTS

| | | | |
|---|---|---|---|
| 3,418,992 | 12/1968 | Anderson et al. | 123/182 |
| 3,893,440 | 7/1975 | Dooley | 123/182 |
| 4,204,384 | 5/1980 | Holtermann | 123/182 X |
| 4,326,145 | 4/1982 | Foster et al. | 313/120 |
| 4,414,933 | 11/1983 | Pribnow | 123/182 |

*Primary Examiner*—Willis R. Wolfe, Jr.

*Attorney, Agent, or Firm*—Don J. Flickinger; Jordan M. Meschkow

[57] ABSTRACT

The combustion chamber of an internal combustion engine is provided with a vent passage. The passage is normally closed by a valve which opens in response to an opening pressure having a predetermined magnitude intermediate the magnitude of the normal combustion pressure and the pressure at which detonation occurs. The passage and the valve may be carried by either the permanent portion of the engine or a replaceable portion, such as a spark plug.

20 Claims, 13 Drawing Figures

FIG. 9
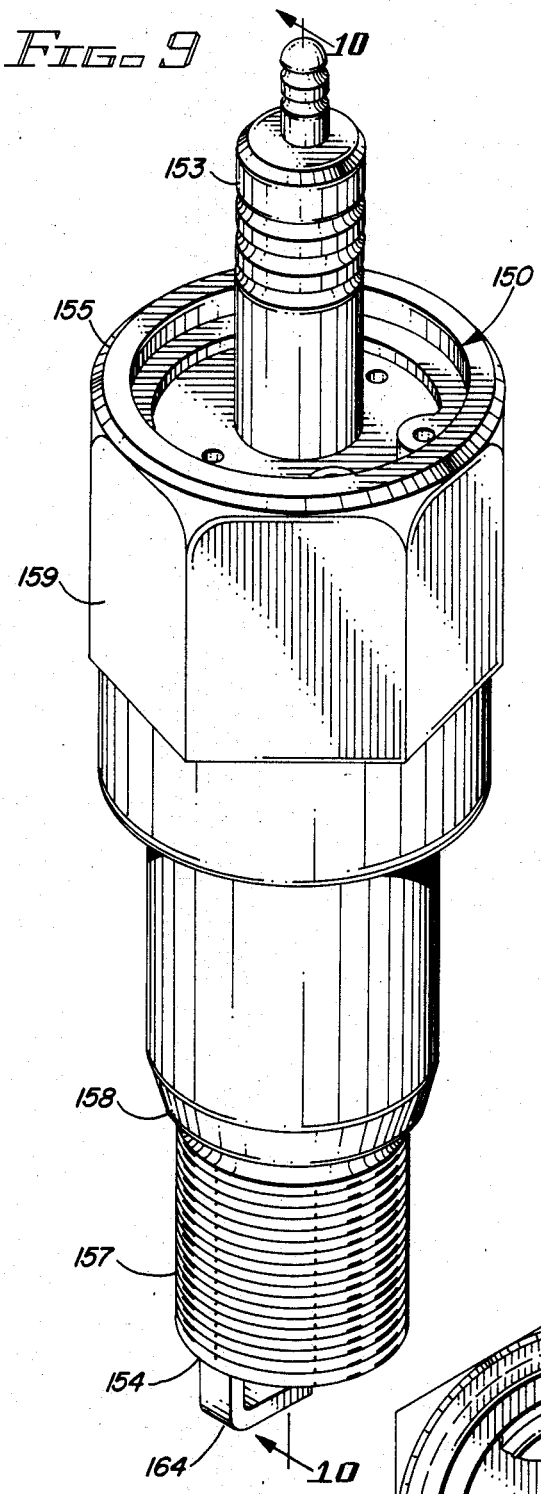
FIG. 10
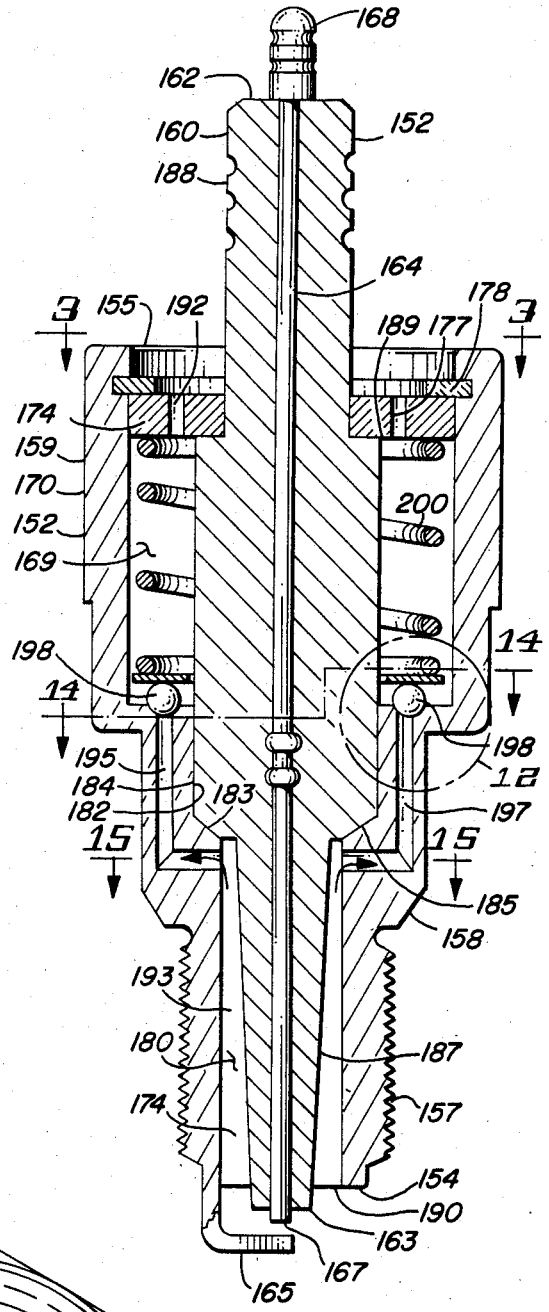
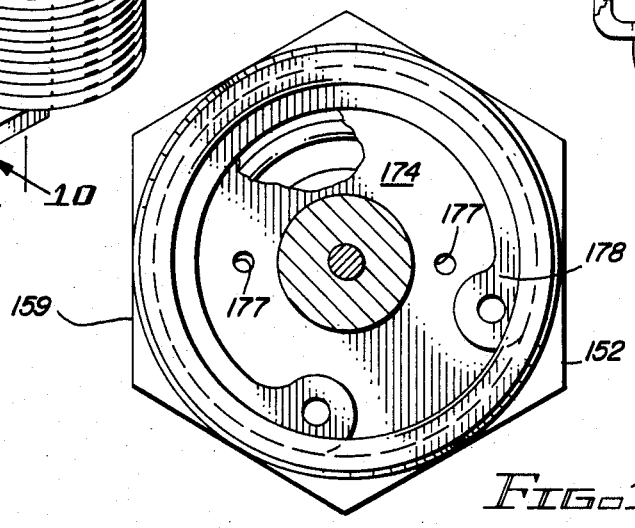
FIG. 13

DETONATION PREVENTION MEANS FOR INTERNAL COMBUSTION ENGINE

CROSS REFERENCE TO RELATED APPLICATION

The instant application is a continuation-in-part of the common inventor's co-pending application Ser. No. 689,064, filed Jan. 7, 1985 and entitle Detonation Prevention Means For Internal Combustion Engine, now abandoned.

BACKGROUND OF THE INVENTION

1. Field of the Invention

This invention relates to internal combustion engines. More specifically, the present invention relates to means for preventing detonation in internal combustion engines.

In a further and more specific aspect, the instant invention concerns means for venting excess pressure from the combustion chamber of an internal combustion engine.

2. The Prior Art

Detonation is a phenomenon well known to those skilled in the art of internal combustion engines. During the compression cycle, as the piston moves upwardly within the cylinder, the fuel/air mixture is compressed within the combustion chamber. At a predetermined time, as controlled by the ignition system, the spark plug produces an electrical spark to ignite the compressed mixture, known as the charge. In a properly functioning engine, combustion of the charge proceeds as a flame-front progressing from the point of ignition. The gases of combustion, expanding at a controlled rate, drive the piston downwardly, commencing the power cycle.

During detonation, combustion of the charge is uncontrolled. As a result of excessive engine loading, improper fuel/air mixture, extreme ambient temperatures, and numerous other determinants, the charge burns at an accelerated rate. In extreme cases, simultaneous burning at the entire charge may occur in a literal explosion. Since the piston is unable to move in direct response to the uncontrolled combustion, and may be still traveling upwardly in the compression stroke, the burning charge and the gases being produced are subjected to compression rather than being allowed to expand.

A discernible pressure differential exists between controlled and uncontrolled combustion. Maximum combustion pressure, in a normally functioning internal combustion engine, is of a magnitude in the range of 800 to 900 pounds per square inch. Detonation generally occurs when the pressure within the combustion chamber achieves a magnitude in the range of 1100 to 1200 pounds per square inch. Accordingly, it is apparent that detonation is preceded by a rise in pressure.

In addition to producing an audible indication, colloquially known as "knock" or "ping", detonation can be extremely deleterious to the engine. In minor cases, detonation may result only in temporary loss of engine performance or damage to the spark plugs. Extreme or prolonged detonation is responsible for such major damage as broken connecting rods and burned pistons.

The occurrence of detonation has been recognized by the prior art for many years. Various purported solutions have been advanced. In general, attempts to suppress detonation involve providing secondary chambers or cavities. One configuration of secondary chamber was especially devised to provide a cushioning effect for the burning charges. The cavities in other designs are for the purpose of attenuating acoustic waves.

Such efforts by the prior art, however, have been generally unsuccessful. It is now known that detonation is preceded by an excessive increase in pressure. Under normal conditions, where the pressure increase in the combustion chamber is insufficient to produce detonation, an auxiliary chamber presents an escape for the expanding gases which are deterred from exerting force upon the piston. In cases of extreme detonation, the auxiliary chamber is insufficient to accommodate the excess pressure. It is also noted that providing an auxiliary chamber is exceedingly expensive and not compatible with conventional production-line manufacturing techniques.

It would be highly advantageous, therefore, to remedy the foregoing and other deficiencies inherent in the prior art.

Accordingly, it is an object of the present invention to provide improved means for attending to detonation in an internal combustion engine.

Another object of the invention is the provision of means for the prevention of detonation.

And another object of this invention is to provide means for venting excess pressure from the combustion chamber of an internal combustion engine.

Still another object of the invention is the provision of detonation control means suitable for original equipment manufacture or retrofit to pre-existing internal combustion engines.

Yet another object of the instant invention, in accordance with one embodiment thereof, is to provide detonation prevention means which can be installed as an integral part of an internal combustion engine with minimal tools and skills.

Yet still another object of the invention is the provision of detonation prevention means which, in accordance with another embodiment thereof, can be incorporated into an internal combustion engine without modification to the engine.

And a further object of the invention is to provide detonation prevention means which is readily and conveniently adjustable to accommodate the operating characteristics of a particular engine.

Still a further object of the immediate invention is the provision of readily replaceable pressure relief means for an internal combustion engine.

Yet a further object of the invention is to provide detonation prevention means which is relatively maintenance free and extremely effective.

And yet a further object of the invention is the provision of means, according to the foregoing, which is relatively simple and inexpensive to manufacture.

SUMMARY OF THE INVENTION

Briefly, in order to achieve the desired objects of the instant invention, in accordance with a preferred embodiment thereof, provided is a passage communicating between the combustion chamber of an internal combustion engine and a region of lesser pressure than the maximum desirable pressure within the combustion chamber. The region of lesser pressure may, for example, be the exhaust manifold or the intake manifold of the engine or the ambient atmosphere. Further provided are valve means normally closing the passage and opening in response to the pressure exceeding the predetermined maximum normal combustion pressure.

In a specific embodiment of the invention, the valve means includes a valve element matingly engageable with a valve seat formed in the passage. Biasing means exert a force upon the valve element for normally retaining the valve element in engagement with the valve seat. In a further embodiment, adjustment means are provided for selectively adjusting the force exerted by the biasing means upon the valve element. The force exerted by the biasing means, considered the opening force, is of a pre-determined value intermediate the normal combustion pressure and the detonation pressure.

In accordance with a further embodiment of the invention, there is provided an improved spark plug having an elongate body including a lower end communicating with the combustion chamber, an upper end external of the engine and attachment means intermediate the ends securable within the spark plug receiving means of the engine. Center electrodes means, including an insulative member with an electrode extending therethrough, extends longitudinally through the body. A passage having an inlet communicating with the combustion chamber and an outlet external with the engine extends through the plug. Further provided are valve means normally closing the passage and opening in response to pressure within the combustion chamber achieving a magnitude intermediate to combustion pressure and the detonation pressure.

More specifically, the improved spark plug includes a chamber formed into the body and coaxial with the center electrode means. The open upper end of the chamber is normally closed by a removable, foraminous end wall through which the center electrode means passes. An inlet port communicates between the inlet and the chamber. An outlet port communicated between the chamber and the outlet. A coiled compression spring, carried within the chamber and encircling the center electrode means bears against the end wall and a valve member normally held within a sealing engagement with the inlet port.

The improvements of the instant invention may be incorporated directly into the appropriate component, such as the cylinder, of an internal combustion engine. Alternately, the improvements may reside within a spark plug to be engaged with the engine. It is also contemplated that the valve means and at least a portion of the passage may be carried within a housing engageable either with the engine or with the spark plug.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings in which:

FIG. 9 is a perspective view of an alternate spark plug constructed in an accordance with the teachings of the instant invention;

FIG. 10 is a vertical sectional view taken along line 10—10 of FIG. 9;

FIG. 13 is a horizontal sectional view taken along the line 13—13 of FIG. 10;

DETAILED DESCRIPTION OF THE PREFERRED EMBODIMENTS

Figure 1:
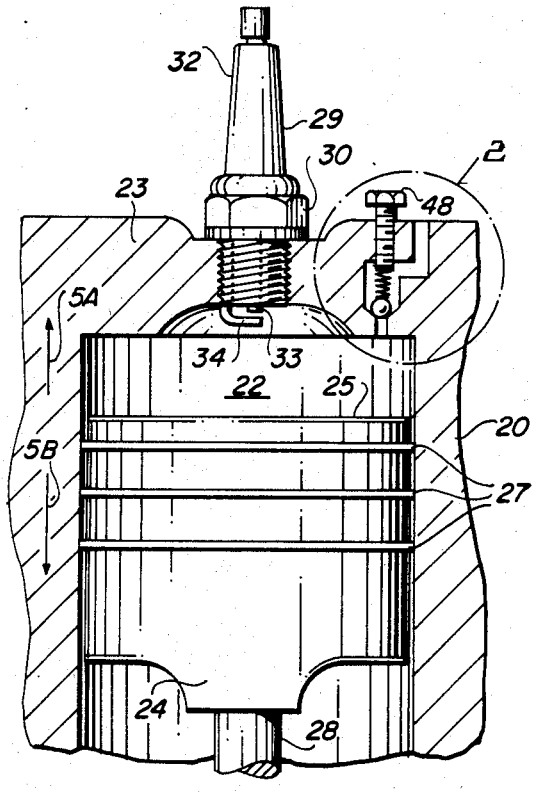
FIG. 1 is a fragmentary elevational view, partly in section, of the cylinder/piston assembly of a conventional internal combustion engine including an embodiment of the detonation prevention means of the instant invention.

Turning now to the drawings in which like reference characters indicate corresponding elements throughout the several views, attention is first directed to FIG. 1 which illustrates in fragmentary section, the portion of an internal combustion engine of immediate interest. Shown is a cylinder 20 having cylindrical bore 22 which is closed at the upper end by head 23. Piston 24 is slidably disposed within cylinder 20 for reciprocal movement in directions, which for purposes of orientation, are considered to be up and down as represented by the arrowed lines A and B, respectively. Piston 24 further includes top 25, which opposes head 23, rings 27 which sealingly engage bore 22, and connecting rod 28 which is generally connected to a crankshaft. Spark plug 29 having body portion 30 and insulator portion 32 is threadedly engaged within head 23. Electrodes 33 and 34 carried by spark plug 29 reside within cylinder bore 22. It is noted that a space or "gap" exists between the electrodes 33 and 34.

Cylinder 20 and piston 24 define a combustion chamber within bore 22 between head 23 and top 25. During the compression stoke, as piston 24 moves downwardly in the direction indicated by the arrowed line B, fuel/air mixture is drawn into the chamber, usually through a valve not specifically shown. During the compression stroke, as piston 24 moves upwardly in the direction of arrowed line A, the fuel/air mixture, now referred to as a charge is compressed. At an appropriate time, as determined by the ignition system, a spark is caused to jump the gap between electrodes 33 and 34. As a result thereof, the charge is ignited commencing the power stroke and driving piston 24 downwardly in the direction of arrowed line B.

The foregoing brief description is set forth for purposes of immediate orientation and reference in connection with the ensuing description of the instant invention. Other further and more specific details of the functioning and operation of an internal combustion engine are well known to those skilled in the art.

In a properly functioning engine, the charge burns in a smooth flame front originating from point of ignition at the electrodes. The ignition is timed such that no further compression of the charge takes place and all of the energy from the burning charge is available to exert a downward force upon the top 25 of piston 24. Detonation occurs, for example when the expanding gases of ignition exert a downward force upon top 25 while piston 24 is still traveling upwardly in the direction of arrowed line B. Generally, this is either a result of premature ignition of the charge or an erratic ignition caused by reasons other than the spark plug, in which the expanding gases are further compressed as piston 24 continues to move upwardly in the direction of arrowed line A. In the typical internal combustion engine, operating under satisfactory conditions, the normal combustion pressure is usually in the rnage of 800 to 900 pounds per square inch. This may be considered the normal combustion pressure. The maximum value for any given engine can be readily determined. Detonation occurs at a substantially elevated pressure. Accordingly, it is apparent that an increase in pressure beyond the desired maximum value takes place prior to the occurrence of the symptoms of detonation.

Figure 2:
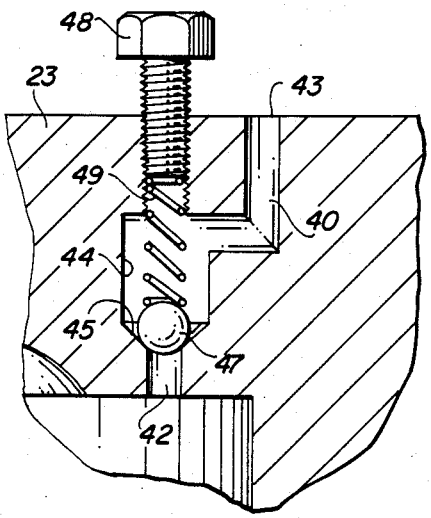
FIG. 2 is an enlarged fragmentary elevational view of the detonation prevention means of the instant invention seen in FIG. 1 and lying within the broken outline circle designated 2.

The instant invention provides improvements for an internal combustion engine for venting the chamber when the pressure exceeds a predetermined maximum value thereby preventing the occurrence of detonation. With reference to FIG. 2, there is seen an embodiment of the instant invention including passage 40 extending through head 23 and terminating with inlet port 42 adjacent the combustion chamber and outlet port 43 communicating with the ambient atmosphere extenal of cylinder 20. Cavity 44 is formed at an intermediate location of passage 40. Cavity 44 terminates at the end adjacent inlet port 42, with frusto-conical valve seat 45. A valve element in the form of ball 47 is matingly engageable with valve seat 45. Screw 48 is threadedly engaged with head 23. Compression spring 49 having an end abutting the end of adjustment screw 48 and another end abutting ball 45, resides within cavity 44. In accordance with the immediately preferred embodiment of the invention, the portion of passage 40 adjacent inlet port 42, valve seat 45 spring 49 and screw 48 are aligned along a common longitudinal axis.

The valve seat, the valve element and the spring function as valve means for normally closing passage 42. Spring 49 fucntions as biasing means for normally holding the valve element in mating engagement with the valve seat. Screw 48 functions as adjustment means for exerting a force upon ball 47 which is equal to the maximum value of pressure desired within the combustion chamber. For purposes of reference, the "maximum" value of pressure desired, can be interpreted as a pre-determined opening pressure intermediate the normal pressure of combustion and the pressure at which detonation occurs. In response to the pressure within the combustion chamber exceeding the maximum value, ball 47 is unseated from valve seat 45 against spring 49 whereby the excess pressure may be vented and the occurence of detonation prevented. The venting proceeds for only a very short period of time with the valve means closing immediately thereafter, prior to the next ignition cycle of the engine.

As will be appreciated by those skilled in the art, adjustment screw 48 may be eliminated and spring 49 chosen to have a rate commensurate with the desired maximum pressure. Screw 48 provides for adjusting the tension of spring 49 to accommodate manufacturing tolerances. Further, screw 48 provides for "fine tuning" wherein the maximum pressure value within the combustion chamber can be regulated in accordance with the peculiar operating characteristics of the particular engine.

Figure 3:
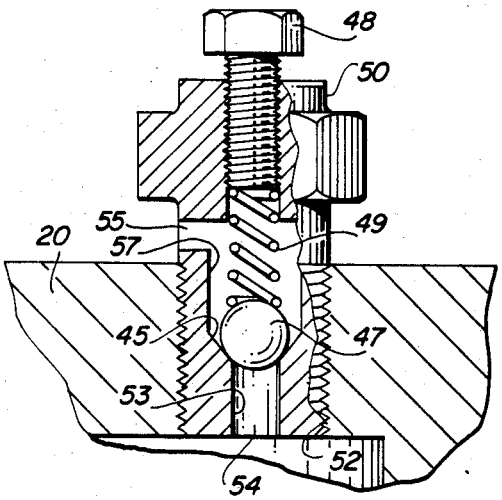
FIG. 3 is a view generally corresponding to the view of FIG. 2 and illustrating an alternate embodiment of a detonation prevention means incorporation the principles of the instant invention.

Seen in FIG. 3 is an alternate embodiment of the invention wherein the valve means is carried in a housing 50 engageable within opening 52 within cylinder 20. For this purpose in accordance with the immediately proffered embodiment of the invention, opening 52 and housing 50 are provided with mating female and male threads, respectively. In general analogy to the previously described embodiment, passage 53 extends through housing 50 terminating with inlet port 54 and outlet port 55. Cavity 57 resides intermediate ports 54 and 55. Further included are valve seat 45, ball 47, spring 49 and adjusting screw 48 as previously described. In other aspects, the operation and functioning of the immediate embodiment is analogous to the description provided in connection with the embodiment of FIG. 2.

Figure 4:
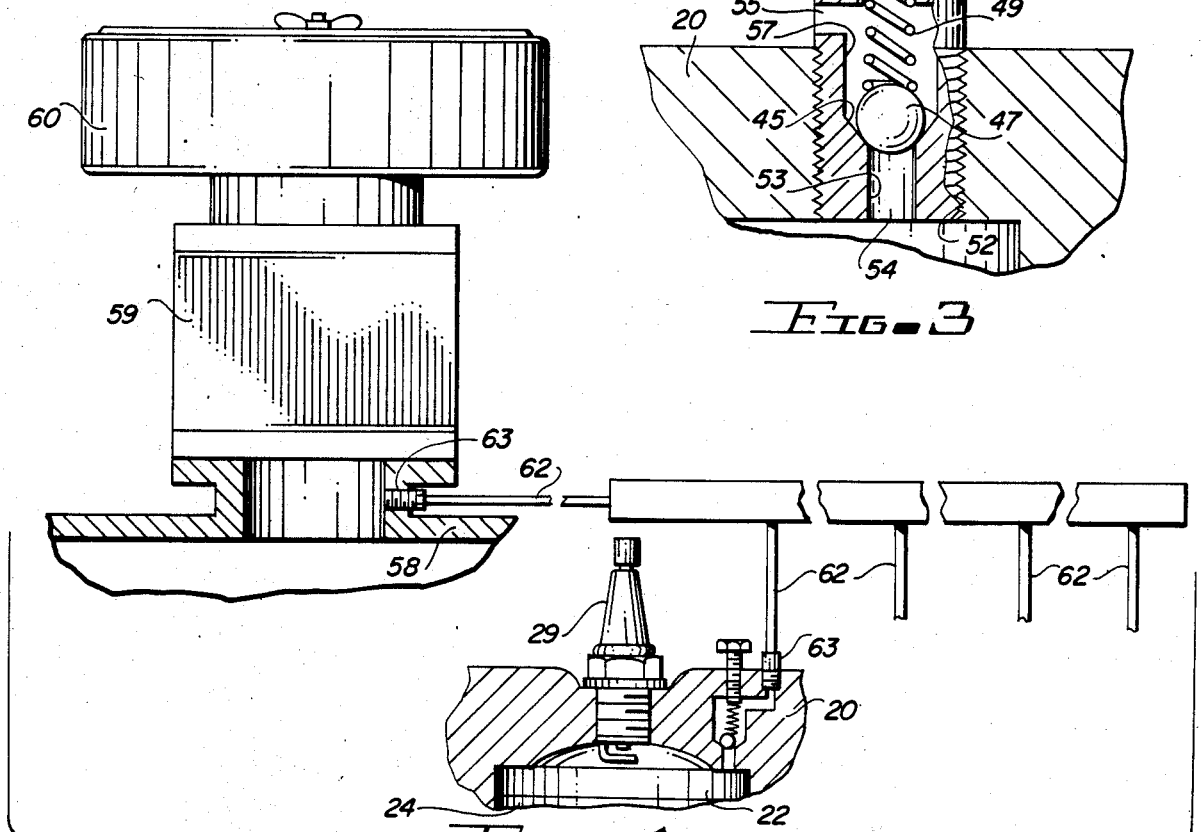
FIG. 4 is a semi-schematic view incorporating the portion of the internal combustion engine seen in FIG. 1 and a portion of the fuel/air intake system and specifically showing emission control means useful in connection with the instant invention.

Emission control means for use in connection with the instant invention will now be described with reference to FIG. 4. Seen is the intake system including intake manifold carburetor 59 and air filter 60 of the typical engine of which cylinder 20 is a part. Conduit 62 communicates between cylinder 20 and the intake system. In accordance with a specifically preferred embodiment of the instant invention, conduit 62 may be in the form of a metallic or plastic tube. An appropriate commercially available fitting 63 is engaged with the outlet port 43 as seen in FIG. 2. Another fitting 63 is engaged with an appropriately sized threaded opening within intake manifold 58. The conduit 62 communicated between the fittings 63. The conduit 62 and the fittings 63 are installed in accordance with conventional technique as will be readily understood by those skilled in the art. It is also understood that the emission return apparatus may, again in accordance with conventional technique, be used in connection with the embodiment of the invention illustrated in FIG. 3.

Figure 5:
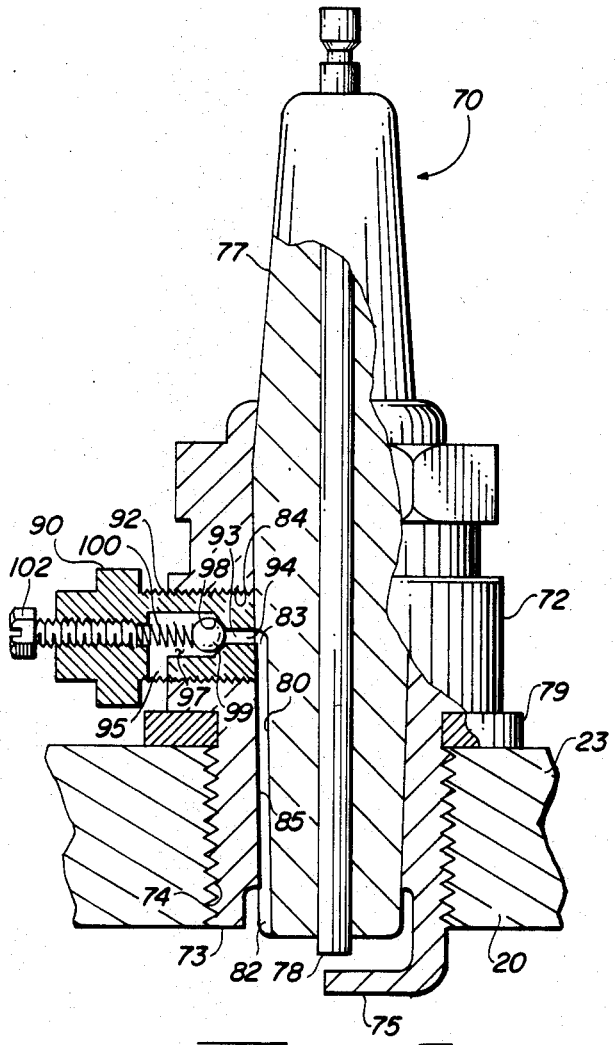
FIG. 5 is an elevational view, partly in section, of a spark plug incorporating detonation control means of the instant invention.

Attention is now directed to FIG. 5 which illustrates a spark plug, generally designated by the reference character 70, improved in accordance with the teachings of the instant invention to provide means for venting the chamber of an internal combustion engine when the pressure within the chamber exceeds the prescribed maximum value. In accordance with conventional practice, spark plug 70 includes a body 72 having a threaded portion 73, which is threadedly engaged within opening 74 in cylinder head 23, and carrying outer electrode 75. Insulator 77 encasing center electrode 78 is carried by body 72. Gasket 79 insures a sealing engagement between spark plug 70 and cylinder 20. In further analogy to conventional practice, as will be appreciated by those skilled in the art, body 72 is fabricated of a metallic material while insulator 77 is generally fabricated of a ceramic material.

In accordance with the instant invention, a passage 80 having first end 82 and second end 83 is formed in insulator 77 and threaded opening 84 is formed in body 72. For convenience of manufacture, passage 80 is formed as a groove in insulator 77. The open side of the groove is closed by the inner side wall 85 of body 72 at the time of assembly to form passage 80.

A housing 90 is carried by spark plug 70 by virtue of threaded portion 92 being engaged within opening 84. Being structurally and functionally analogous to the previously described body 50, seen in FIG. 3, housing 90 includes passage 93 extending therethrough and terminating with inlet opening 94 and outlet opening 95. Passage 93 is expanded to form cavity 97 intermediate the openings 94 and 95. Housing 90 further includes valve seat 98, valve element 99, biasing means 100 and adjusting screw 102.

Passage 93 in body 90 is an extension of passage 80 in spark plug 70, inlet end 94 of passage 93 being in alignment with second end 83 of passage 80. Accordingly, passage 80 and passage 93 cooperate to form a single passage of which first end 82 of passage 80 is considered the inlet port and outlet opening 95 of passage 93 is considered the outlet port. In all aspects not herein specifically described, the immediate embodiment is structurally and functionally analogous to the embodiment illustrated in FIG. 3.

Figure 6:
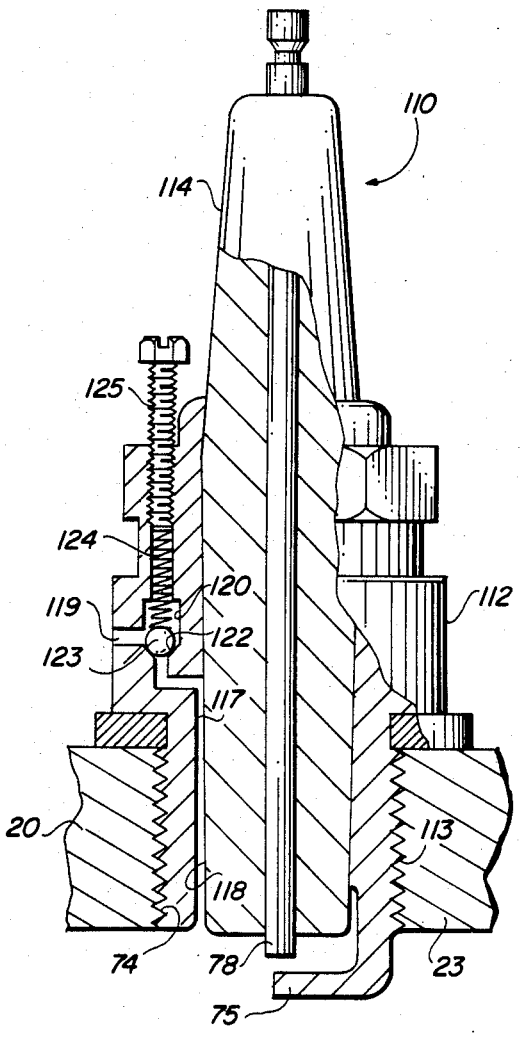
FIG. 6 is a view generally corresponding to the illustration of FIG. 5 and showing yet another embodiment thereof.

FIG. 6 illustrated another spark plug of a typically commercial type and improved in accordance with the teachings of the instant invention. The spark plug, generally designated with the reference character 110 includes body 102 having threaded portion 103 and insulator 104.

In accordance with the improvement of the instant invention, passage 117 extends through body 112 terminating with inlet port 188 and exhaust port 119. It is noted that a portion of passage 117 is in the form of a groove, the open side of which is closed by insulator 114. Cavity 120 having integral frusto-conical valve seat 122 is formed in passage 117 intermediate the ports 118 and 119. Ball 123 is normally held in mating engagement with the valve seat 122 by compression spring 124. Adjustment screw 125 controls the force exerted by compression spring 124 and ball 123. An understanding of the interaction between the several elements to achieve the desired objects of the instant invention can be had with reference to the previously described embodiments.

Figure 7:
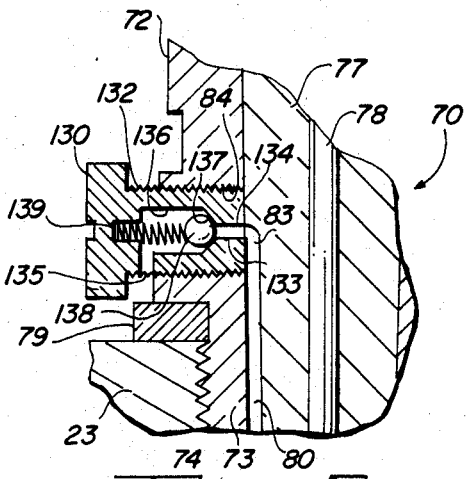
FIG. 7 is a fragmentary vertical section view of a spark plug, generally corresponding to the illustration of FIG. 5, and showing still another detonation prevention means embodying the principles of the instant invention.

An alternate housing 130 having threaded portion 132 and engageable with the previously described spark plug 70, is seen in FIG. 7. Passage 133 having inlet opening 134 and outlet opening 135 extend through housing 130. Cavity 135 and valve seat 137 are formed in housing 130. Ball 138 is normally held in mating engagement with valve seat 137 to close passage 133 by compression spring 139. With the exception of adjusting screw 102, the immediate embodiment is the structural and functional equivalent of the embodiment described in greater detail in connection with FIG. 5.

Figure 8:
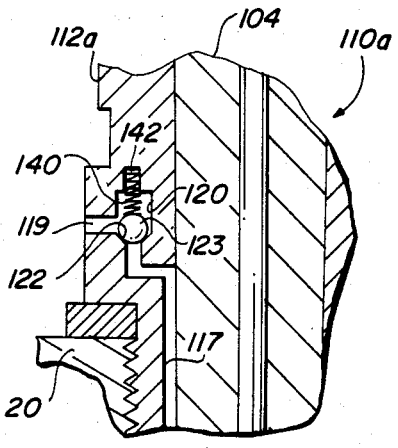
FIG. 8 is a view generally corresponding to the illustration of FIG. 7 and showing yet another embodiment of the instant invention.

Reference is now made to FIG. 8 which illustrates a variation of the embodiment of the invention previously described in connection with FIG. 6. For purposes of distinction, the immediate spark plug is generally designated by the reference character 110A having body 112A. In common, the embodiments include passage 117 having inlet port 118 (not specifically herein illustrated) and outlet port 119. Cavity 120 and valve seat 122 are formed in passage 117. Ball 123 is matingly engageable with valve seat 122.

In contrast to the previously described embodiment, ball 123 as seen in the immediate embodiment is normally held against valve seat 122 by fixed rate compression spring 140. One end of spring 140 bears against ball 123 while the other end is housed within blind bore 142 to maintain the spring in axial alignment with ball 123 and valve seat 122. It will be appreciated that except for means for varying the tension of the spring against the ball, including adjusting screw 125, the immediate embodiment is the equivalent of the embodiment described in connection with FIG. 6.

Turning now to FIG. 9 there is seen another embodiment of an improved spark plug generally designated by the reference character 150 having body 152 and carrying center electrode means 153.

Body 152, in common with the analogous component of conventional spark plugs, is generally elongate having lower end 154 which communicates with the combustion chamber and an upper-end 155 which resides of the engine. A threaded portion 157, proximate lower end 154, functions as attachment means securable within the spark plug receiving means, normally a threaded bore, within the internal combustion engine. Frusto-conical seat 158 engages a mating surface at the external end of the threaded bore for sealing engagement with the engine. Wrench receiving means 159, generally hexagonal in cross-section and having a plurality of plan surfaces, resides proximate upper-end 155.

In general similarity to central electrode means of conventional design, center electrode means 153, as seen with further reference to FIG. 10, includes elongate insulator 160 having upper-end 162 and lower-end 163. Center electrode 164 extends through insulator 160, Preferably, body 152 and center electrode 164 are fabricated of a conductive material such as metal. Being non-conductive, insulator 160 is readily fabricated from various materials such as sintered ceramic. For purposes of illustration, spark plug 150 is illustrated as being of the conventional gap type wherein side electrode 165 extends downwardly then inwardly from the lower end 154 of body 152 to reside in spaced opposition with the lower end 167 of center electrode 164. The upper-end 168 of center electrode 164 projects beyond the upper-end 162 of insulator 160 for attachment of a spark plug wire. Other spark plug configurations, such as the surface gap type, are well known in the art. Accordingly, the foregoing is set forth for purposes of illustration and is not considered to be limiting upon the ensuing detailed description of the inventive aspects of the improved spark plug.

Figure 11:
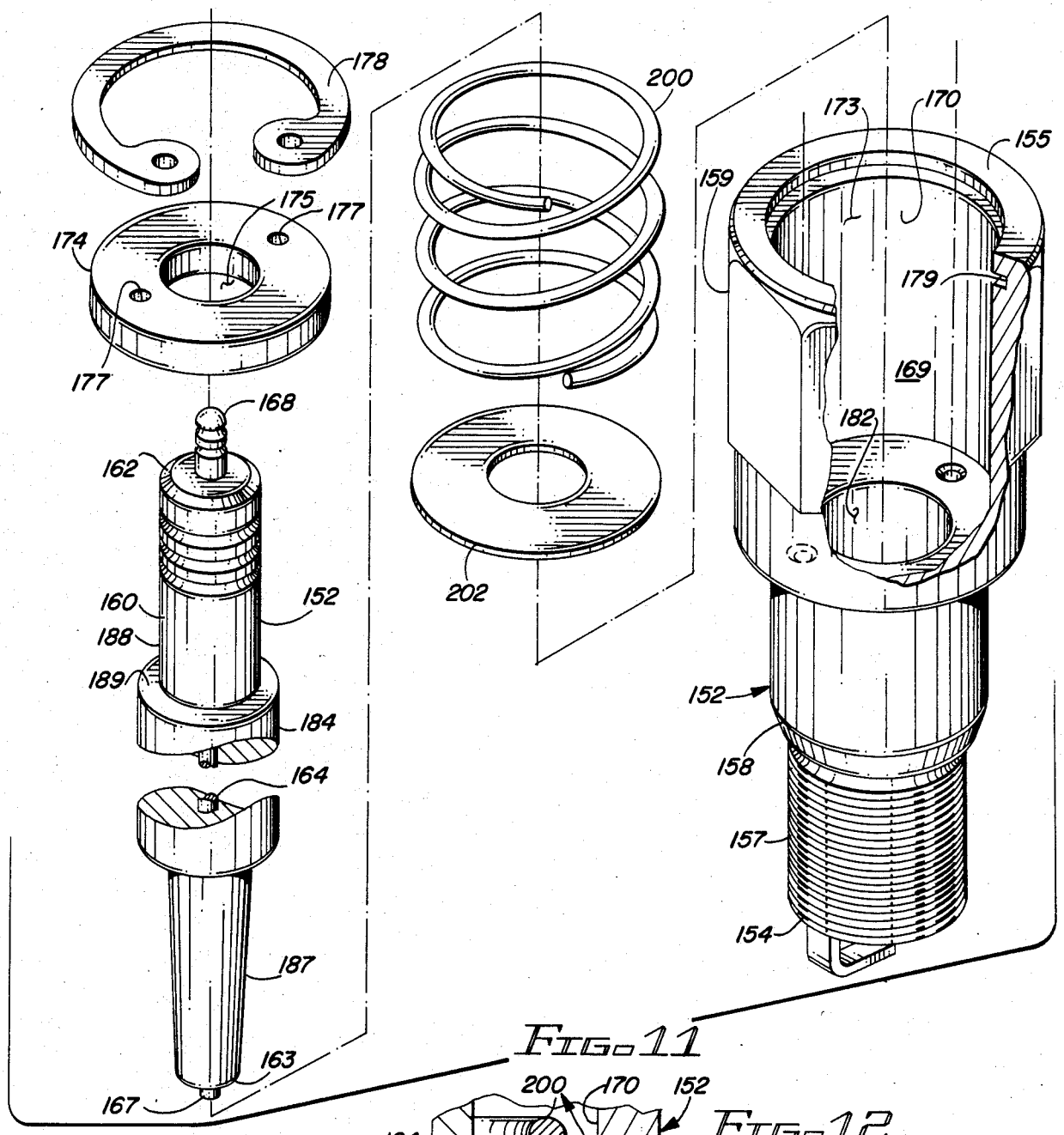
FIG. 11 is an exploded perspective view of the spark plug of FIG. 9, portions thereof being broken away for purposes of illustrations.

In accordance with the immediately preferred embodiment of the invention, as specifically illustrated in FIGS. 10 and 11, a chamber 169 is formed in the upper portion of body 152. Preferably, chamber 169 is in the form of a cylindrical bore extending to body 152 coaxial with the longitudinal axis thereof from upper-end 155. Accordingly, chamber 169 is defined by continuous side wall 170 terminating at the lower end with inwardly directed annular shoulder 172 spaced from an open upper-end 173. Disc like member 174, having coaxial bore 175 and apertures 177 extending therethrough, is sized to be received within side wall 170. Internal snap ring 178, receivable within angular groove 179 functions to retain disc-like member 174 within side wall 170 whereby disc-like member 174 functions as an end wall for normally closing chamber 169. Further description of end wall 174 and snap ring 178 will be made presently.

Bore 180, generally coaxial with side wall with 170, extends from chamber 169 through lower end 154 of body 152. Counterbore 182, projecting downwardly from angular shoulder 172 coaxial with bore 180, terminates with inwardly downwardly directed frusto-conical surface 183 extending to bore 180.

Insulator 160 includes intermediate body portion 184 sized and shaped to be received within counterbore 182 and terminating at the lower-end with annular surface 185 which is matingly received against surface 183. Lower portion 187 depends from body portion 184 through bore 180. Upper portion 188 projects upwardly from body portion 184 through bore 175 in disc-like member 174. Annular shoulder 189, intermediate body portion 189 and upper portion 188, resides at the under surface of disc-like member 174.

It is within the scope of the instant invention, that center electrode means 153 is permanently and sealingly engaged within body 152 in accordance with conventional practice in the art. Alternately, the components may be detachably engaged. In the later case, a locational fit exists between counterbore 182 and the extent of body portion 184 received therein. Surfaces 183 and 185 function as an annular seat and an annular seal surface, respectively. Disc-like member 174 and snap ring 178 function as retention means bearing against shoulder 189 compressively urging body portion 184 downwardly for sealing engagement between the surfaces 183 and 185.

Figure 15:
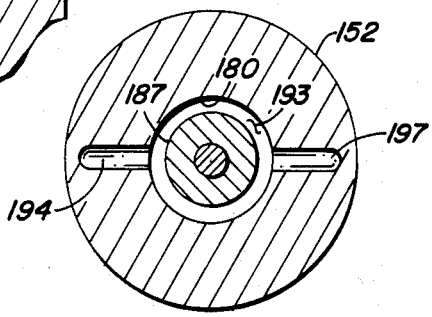
FIG. 15 is a horizontal sectional view taken along line the 15–13 of FIG. 10.

A passage, as previously noted in connection with the embodiments designated by reference characters 70 and 110, extends through spark plug 150 for the passage of gas and the concurrent partial venting of the combustion chamber under certain pre-determined conditions. In accordance with the immediate embodiment, the passage is defined as extending between an inlet 190 provided by the opening of bore 180 at the lower-end 154 of body 152 and an outlet 192 described as the external end of aperture 177. Chamber 169 functions as an intermediate portion of the passage. An inlet port 193 communicates between inlet 190 and chamber 169. The first or initial portion, as further viewed in FIG. 15, of inlet port 193 is the generally annular opening 194 residing intermediate the bore 180 of body 152 and the lower portion 187 of insulator 160. A second portion is in the form of elongate aperture 195 communicating between the first portion 193 and chamber 169. Preferably, a second mirror image, diametrically opposed aperture 197 is also provided apertures 177 functions as outlet ports.

Figure 12:
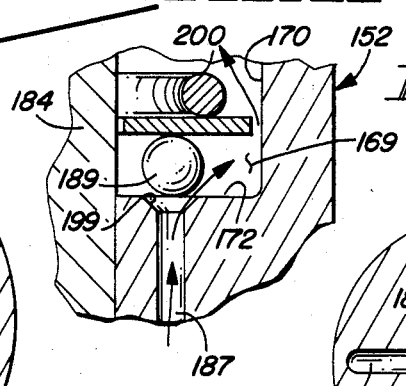
FIG. 12 is an enlarged fragmentary portion taken from with the broken outlined area designated 12 in FIG. 10.
Figure 14:
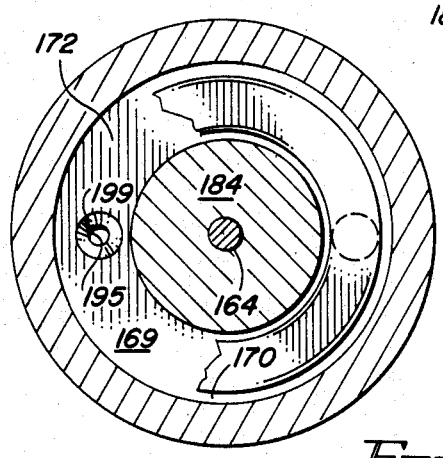
FIG. 14 is an off-set horizontal sectional view taken along line 14—14 of FIG. 10.

A valve element is sealingly engageable with the inlet port. As seen in detail in FIG. 12, a preferred valve element is in the form of ball 198 which is sealingly engageable with frusto-conical seat 199 carried at the juncture of shoulder 172 and each aperture 195 and 197. A preferred biasing means for urging ball 198 into sealing engagement with seat 199 is coiled compression spring 200 clearly illustrated in FIG. 11 in which is further noted annular plate 202. Referring again to FIG. 10, it is seen that spring 200, which is sized to be received within chamber 169 while encircling insulator 152, is held in compression between the valve elements 198 and disc-like member 174 which in addition to providing an end member for chamber 169 and other noted utility, functions in cooperation with snap ring 198 as retention means for spring 200. Annular plate 202, as further viewed in FIG. 14, resides intermediate spring 200 and the elements 198 for even distribution of pressure over the several valve elements.

The detachable engagement of end member 174 with body 152 by snap ring 178 is clearly illustrated in FIG. 13. Also seen are the apertures 177. While two apertures 177 were chosen for purpose of illustration, it will readily occur to those skilled in the art that end member 174 may be made foraminous by other conventional techniques.

As previously noted, spring 200 is held in compression between the elements 198 and end member 174. The rate of spring 200, that is, the pressure exerted upon elements 198, is chosen in accordance with the function prescribed by the instant invention. The rate, which for purposes of illustration may be the opening pressure, is of a magnitude which is intermediate the magnitude of normal combustion pressure being generated within the combustion chamber in response to combustion of the fuel and the detonation pressure which is of a determinable magnitude greater than normal combustion pressure. Spring rates, which are determinable by numerous factors, are readily calculated by those skilled in the art. In accordance with the teachings of the instant invention, the opening pressure of a given spring can be readily varied for custom application for a particular engine by selecting an annular plate 202 having a particular thickness or the utilization of additional plates 202 as shown.

Experimentation has proven the effectiveness of the immediate invention. The test vehicle was a 1980 Pontiac Phoenix having a four-cylinder 2.5 liter engine. The cylinder head was modified in accordance with the teachings of the instant invention to provide detonation prevention means for each cylinder. Various efforts, including excessively advanced ignition timing were then made to induce detonation. Imperical observation failed to reveal the occurrence of the phenomenon normally accompanying detonation. However, it was observed that excess pressure was vented. At the same time, there was no observable loss of engine power.

Various changes and modifications to the embodiments herein chosen for purposes of illustration will readily occur to those skilled in the art. To the extent that such modifications and variations to no depart from the spirit of the invention, they are intended to be included within the scope thereof which is limited only with a fair interpretation of the following claims.

Having full described and disclosed the instant invention, and alternately preferred embodiments thereof, in such clear and concise terms to enable those skilled in the art to understand and practice the same, the invention claimed is:

1. In an internal combustion engine including
a cylinder, and
a piston reciprocally movable within said cylinder,
said cylinder and said piston defining a chamber for compression and combustion of gaseous fuel,
a normal combustion pressure of determinable magnitude being generated within said chamber in response to said combustion,
a detonation pressure of determinable magnitude capable of being generated within said chamber, said detonation pressure being of greater magnitude than said combustion pressure, improvements therein for preventing occurance of detonation within said engine, said improvements comprising:

a. a passage communicating between said chamber and a region of lesser pressure than said combustion pressure;

b. valve means including i. a generally frusto-conical valve seat formed in said passage, ii. a generally spherical valve element matingly engagable with said seat for closing said passage, and iii. biasing means for exerting a force upon said element for normally retaining said element in engagement with said seat, and said valve means normally closing said passage and opening in response to an opening pressure being attained within said chamber, said opening pressure having a predetermined magnitude intermediate the magnitude of said combustion pressure and of said detonation pressure.

2. In an internal combustion engine including a cylinder, and a piston reciprocally movable within said cylinder, said cylinder and said piston defining a chamber for compression and combustion of gaseous fuel, a normal combustion pressure of determinable magnitude being generated with said chamber in response to said combustion, a detonation pressure of determinable magnitude capable of being generated within said chamber, said detonation pressure being of greater magnitude than said combustion pressure, improvements therein for preventing occurance of detonation within said engine, said improvements comprising:

a. a passage communicating between said chamber and a region of lesser pressure than said combustion pressure;

b. valve means including i. a valve seat formed in said passage, ii. a valve element matingly engagable with said seat for closing said passage, iii. a compression spring having an end bearing against said valve element for normally retaining said element in engagement with said seat and having another end, and iv. an adjustment screw having an end bearing against the other end of said spring for selectively varying the force said spring exerts upon said valve element said valve means normally closing said passage and opening in response to an opening pressure being attained within said chamber, said opening pressure having a predetermined magnitude intermediate the magnitude of said combustion pressure and of said detonation pressure.

3. In an internal combustion engine including:

a cylinder, a piston reciprocally movable within said cylinder, said cylinder and said piston defining a chamber for the compression of gaseous fuel, and a spark plug carried in said cylinder for ignition and combustion of said gaseous fuel, said spark plug having an external portion in communication with said chamber and an external postion extending from said cylinder, a normal combustion pressure of determinable magnitude being generated within said chamber in response to the combustion of said fuel, a detonation pressure of determinable magnitude capable of being generated within said chamber, said detonation pressure being of greater magnitude than said combustion pressure, improvements therein for preventing the occurrence of detonation within said engine, said improvements comprising:

a. a passage extending through said spark plug and including i. an inlet port at the internal portion of said spark plug, and ii. an outlet port at the external portion of said spark plug; and b. valve means carried by said spark plug for normally closing said passage and opening pressure being attained within said chamber, said opening pressure having a magnitude intermediate the magnitude of said combustion pressure and of said detonation pressure.

4. The improvements of claim 3, wherein said valve means includes:

a. a valve seat formed in said passage:

b. a valve element matingly engagable with said seat for closing said passage; and c. biasing means for exerting a force upon said element for retaining said element in engagement with said seat when pressure within said chamber is lessor than said opening pressure.

5. The improvements of claim 4, further including adjustment means for selectively varying the force said biasing means exerts upon said valve element.

6. The improvements of claim 5, wherein:

a. said biasing means is in the form of a compression spring having i. an end bearing against said valve element, and ii. another end; and b. said adjustment means in in the form of an adjustment screw having an end bearing against the other end of said spring.

7. The improvements of claim 3, further including:

a. an opening in said spark plug; and b. a housing engaged within said opening and carrying i. at least a portion of said passage, and ii. said valve means.

8. The improvements of claim 7, wherein said housing further carries said outlet port.

9. The improvements of claim 7, wherein said valve means includes:

a. a valve seat;

b. a valve element sealingly engagable with said valve seat; and c. biasing means for exerting force upon said element for retaining said element in engagement with said seat when pressure within said chamber is lessor than said opening pressure.

10. The improvements of claim 9, further including adjustment means for selectively varying the force said biasing means exerts upon said valve element.

11. An improved spark plug for the ignition of gaseous fuel within the combustion chamber of an internal combustion engine said engine including a spark plug receiving means communicating with said combustion chamber, and having a normal combustion pressure of determinable magnitude being generated within said chamber in response to combustion of said fuel, said engine being capable of attaining a detonation pressure of determinable magnitude greater than said normal combustion pressure, and for preventing the occurrence of detonation within said internal combustion engine, said improved spark plug comprising:

a. an elongate body including
   i. a lower end communicating with said combustion chamber,
   ii. an upper end external of said engine, and
   iii. attachment means intermediate said ends and receivable within said spark plug receiving means;
b. center electrode means extending longitudinally through said body;
c. a passage extending through said spark plug and including
   i. an inlet communicating with said combustion chamber, and
   ii. an outlet external of said engine; and
d. valve means normally closing said passage and opening in expanse to pressure within said combustion chamber acheiving a magnitude intermediate said combustion pressure and said detonation pressure.

12. The improved spark plug of claim 11 wherein said passage includes:

a. a chamber formed in said body and carrying said valve means;
b. an inlet port communicating between said inlet and said chamber; and
c. an outlet port communicating between said chamber and said outlet.

13. The improved spark plug of claim 12, wherein said chamber includes:

a. a continuous upright sidewall spaced from and encircling said center electrode means and extending between
   i. an open upper end, and
   ii. an inwardly directed shoulder spaced from said upper end
   said inlet port projecting through said shoulder;
b. an end member detachably carried proximate the upper end of said side wall
   said outlet port and said center electrode means projecting through said end member.

14. The improved spark plug of claim 13, wherein said end member includes:

a. a gas pervious plate sized to be received within said continuous sidewall, and
b. retainer means removaby engagable with said body for retaining said plate within said sidewall.

15. The improved spark plug of claim 13, wherein said center electrode means is removably carried by said body.

16. The improved spark plug of claim 15, wherein:

a. said body includes
   i. a bore extending between said chamber and said lower end, and
   ii. a counter bore projecting from said chamber and terminating with an inwardly directed annular seat, and
b. said center electrode means includes
   i. a body portion receivable within said counter bore and extending between an annular seal surface matingly engagable with said annular seat and an annular shoulder for receiving said end member thereagainst, said body portion being held in compression between said annular seat and said end member for sealing engagement between said annular seat and said annular seal surface, and
   ii. a lower portion projecting through the bore of said body.

17. The improved spark plug of claim 13, wherein said valve means includes:

a. a valve element sealingly engagable with said inlet port; and
b. biasing means in compression between said valve element and said end member.

18. The improved spark plug of claim 17, wherein said biasing means in the form of a coiled compression encircling said center electrode means.

19. The improved spark plug of claim 18, further including:

a. a second inlet port communicating between the inlet of said passage and the shoulder of said chamber;
b. a second valve member normally held in sealing engagement with said second inlet port by said compression spring.

20. The improved spark plug of claim 19, wherein the inlet of said passage is in the form of a generally annular opening residing coaxial with said center electrode means and said body.

* * * * *